US006240699B1

(12) United States Patent
Scanlon et al.

(10) Patent No.: US 6,240,699 B1
(45) Date of Patent: Jun. 5, 2001

(54) MAGNETIC WEDGE INSTALLER

(76) Inventors: Wayne Alan Scanlon, 5448 Whitman Ave., Fort Worth, TX (US) 76113; Dale Andrew Granger, 1805 N. Trinity, Denton, TX (US) 76208

( * ) Notice: Subject to any disclaimer, the term of this patent is extended or adjusted under 35 U.S.C. 154(b) by 0 days.

(21) Appl. No.: 09/391,867

(22) Filed: Sep. 8, 1999

(51) Int. Cl.[7] ..... E04B 1/00

(52) U.S. Cl. ..... 52/741.1; 29/452; 52/223.1; 52/749.1; 81/27; 81/463; 227/147

(58) Field of Search ..... 52/223.1, 223.6, 52/223.13, 223.14, 741.1, 749.1; 29/452; 81/24, 27, 44, 463; 227/147; 254/29 A

(56) References Cited

U.S. PATENT DOCUMENTS 3,787,957 * 1/1974 Andrews ..... 29/452
3,858,991 * 1/1975 Burtelson ..... 52/223.13 X
4,470,440 * 9/1984 Thor ..... 81/463 X
4,733,812 * 3/1988 Lewis et al. ..... 227/147
4,785,692 * 11/1988 Holmes ..... 81/27
5,875,950 * 3/1999 Nuss et al. ..... 227/147 X

* cited by examiner

*Primary Examiner*—Carl D. Friedman
*Assistant Examiner*—Kevin D. Wilkens
(74) *Attorney, Agent, or Firm*—James J. Murphy, Esq.; Winstead Sechrest & Minick

(57) ABSTRACT

An improved method and apparatus for anchoring tensioning members in a concrete structure and the like wherein there is provided a wedge support member having wedge-receiving pockets coaxially aligned with the anchor seats in an anchorage block permitting the anchorage wedges to first be inserted into the pockets not allowing the tensioning members to slip during tensioning. This method is used in post-tensioning of monostrand cable. The apparatus anchors the tensioning members by installing wedges into their respective wedge seats. A magnetic tip is utilized to hold the wedges in place while a slide hammer provides and transmits the energy to forcibly insert the wedges.

14 Claims, 4 Drawing Sheets

MAGNETIC WEDGE INSTALLER

TECHNICAL FIELD

The present invention relates in general to post tensioning concrete construction and, in particular to the anchoring of monostrand cables extending through a concrete structure.

BACKGROUND INFORMATION

Concrete is strong in compression, but relatively weak in tension. In most structures, such as buildings or bridges, forces such as wind, gravity, and earthquakes subject the structure, and therefore, the concrete to compressive and tensile stresses. Steel reinforcement is typically used to resist the tensile forces within a concrete structural member. The steel reinforcement is placed in the form before the concrete is poured within the tension zone. The steel reinforcement is designed to work with the concrete to resist tension forces and to control concrete cracking. For additional efficiency and economy, steel reinforcement, such as prestressing steel, can be stressed before the building forces are applied to the concrete member in the opposite direction of the to-be-applied force. Such stressing counteracts the applied force and allows the use of less steel reinforcing.

There are two basic methods of stressing concrete before the concrete is subjected to design forces (i.e., prestressing): post-tensioning and pre-tensioning. Pre-tensioned prestressed concrete is usually fabricated at a plant remote from the final construction site. In that case, the steel tendons are stressed before the concrete is placed. With post-tensioned prestressed concrete, steel tendons are stressed after the concrete has been placed and gained sufficient strength at the construction site. The present invention is primarily concerned with post-tensioned prestressed concrete.

With post-tensioned prestressed concrete, after the concrete has hardened, a hydraulic jack is used to pull strands of steel or tendons encased in the concrete. The prestressing steel strands are separated from the concrete by polyethylene sheathing. This sheathing allows the encased steel move with respect to the concrete. Thus, the steel can be stressed without frictional resistance from the concrete which effectively eliminates tensile stresses in the concrete due to the prestressing. The tension force in the steel is then permanently transferred to the concrete as a compressive force through anchoring devices at the end of the concrete member.

In post-tensioned concrete, the concrete is simply poured over the unstressed steel strands or tendons. Initially, therefore, both concrete and steel have no stress. As the concrete cures or hardens, it gains its compressive strength. After about 24 hours, it usually has reached about 75 percent of its full design strength. It is at this point when the steel is stressed. The steel is then stressed to high stresses, (e.g., 216,000 psi) but within its elastic limit. While stressed, the steel is then permanently attached to anchors at the ends of the concrete beam. Thus, the steel is in tension (i.e, pulling on the anchors) while the concrete remains in compression because both anchors are pushing on the concrete. The result is a considerable reserve of compressive stress at the bottom of the beam that in turn can be used to counteract the tensile stresses from an applied load.

Before the concrete is poured, anchorages are set and attached to the form. Once the concrete has hardened, the anchorages are embedded into the concrete. Typically, the anchorages are not flush with the concrete edge. Pocket formers are used to separate the anchorages from the edge of the concrete. Thus, after the concrete has hardened, these pocket formers leave anchorage cavities in the concrete. Anchorage cavities have tapered wedge-receiving seats and passages through which the tensioning cables extend. FIG. 1 is a cross-section of an end of a concrete member 100 through anchorage 105 and anchorage cavity 102. Steel strand 104 extends from polyethylene sheathing 106 through the center of anchorage 105 and anchorage cavity 102.

A stressing ram (not shown) is used to pull the tendon 104 to the correct pressure and elongation. Then, anchoring wedges 108*a* and 108*b* are driven between tendon 104 and the surrounding anchorage 105. The wedges grip tendon 104 as the jack releases it. Thus, the wedges 108*a* and 108*b* keep tendon 104 from slipping back through anchorage 105 into the concrete. Once the all of the tendons have been properly stressed, the ends are cut, the pockets are grouted, and the beam ends are encapsulated to protect the tendons from corrosion.

Wedges 108*a* and 108*b* are pieces of tapered metal with teeth that bite into the prestressing tendon during transfer of the prestressing force. The teeth are beveled at the front end to ensure gradual development of the tendon force over the length of the wedge. Two piece wedges are normally used for monostrand tendons. Proper installation of the wedges into the concrete is critical. The wedges must be evenly spaced and exactly fitted into anchorage 105. If the wedges are unevenly spaced or not properly fitted, the wedges could slip and ruin the entire prestressing operation.

It has been found that it is difficult to properly align, install and seat the wedges. The wedges must be installed into the back surface 103 of anchorage cavity 102 which has limited access. Furthermore, both wedges need to be equally spaced and driven into anchorage 105 by an equal amount. Currently, a small hand held device is used to install the wedges in the anchorage cavity. This small hand held device consists of a bent longitudinal bar. The user positions one wedge into the space between anchorage 105 and protruding tendon 104. Then with the other hand, slides the hand held device along tendon 104 with enough force to partially anchor the wedge into anchorage 105. The user then repeats the procedure for the other wedge on the opposite side of the strand. The tool only allows for partial installation of one wedge at a time. Thus, the user must alternate seating the wedges on both sides of the cable constantly to ensure that the wedges are evenly aligned as they enter their respective wedge seats. This process is time consuming, inefficient and difficult due to the limited space available in the anchorage cavity.

What is needed, therefore, is an efficient and cost-effective device to place the anchorage wedges into the anchorages prior to tensioning the monostrand members.

SUMMARY OF THE INVENTION

The previously mentioned needs are fulfilled with the present invention. Accordingly, there is provided, in a first form, a hand-operated tool with a u-shaped bar with a handle, sliding hammer, a concentric stop and magnetic tip. The cross section shape of the tool is u-shaped to allow the tool to straddle and slide along the tendon. The slide hammer action in the handle of the tool allows the user to apply force to firmly drive the wedges into the respective anchor-wedge seats. The concentric stop is a means transferring the energy of the hammer's momentum to the magnetic tool head. The magnetic tip is designed to hold the wedges around the strand until they can be seated into the concrete anchorage. Thus, the installer can simultaneously set two wedges evenly and correctly in the cavity. After the wedges have been partially seated, the magnetic connection is easily broken as the tool is retracted.

The present invention allows for two or more wedges to be simultaneously installed, as opposed to a single wedge. Furthermore, both wedges can be aligned simultaneously on the magnetic head of the tool, as opposed to working within the confined space of the anchorage cavity. Finally, the seating of the wedges can occur simultaneously, and because the tool places a nearly equal force on both wedges, there is no need for repeated attempts of alignment and seating.

These and other features, and advantages, will be more clearly understood from the following detailed description taken in conjunction with the accompanying drawings. It is important to note the drawings are not intended to represent the only form of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 2:
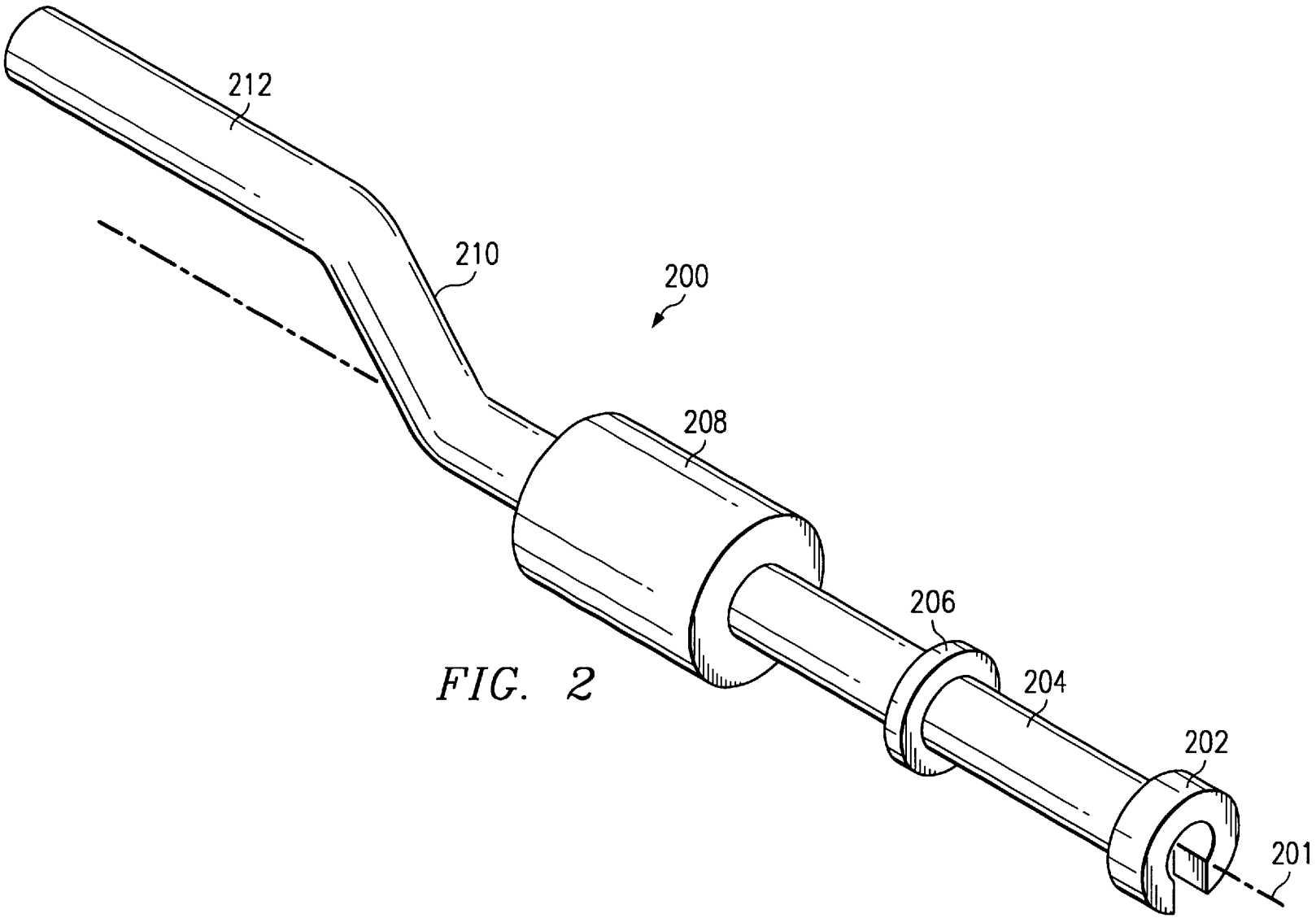
FIG. 2 is an isometric view of the present invention.

The principles of the present invention and their advantages are best understood by referring to the illustrated embodiment depicted in FIG. 2 of the drawings, in which like numbers designate like parts. In the following description, well-known elements are presented without detailed description in order not to obscure the present invention in unnecessary detail. For the most part, details unnecessary to obtain a complete understanding of the present invention have been omitted in as much as such details are within the skills of persons of ordinary skill in the relevant art.

Figure 1:
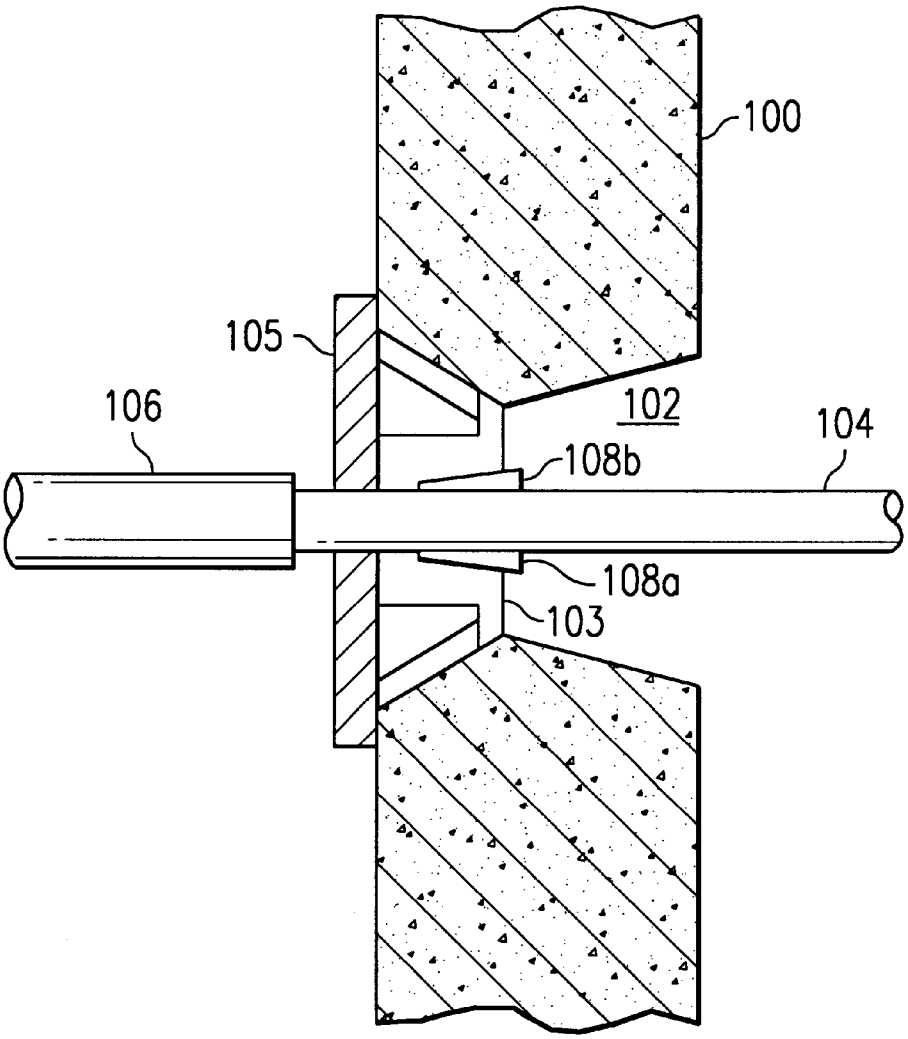
FIG. 1 (PRIOR ART)
FIG. 1 is a cross-section a cavity in a concrete structure and tendon running through the concrete structure and extending beyond the concrete structure.

FIG. 2 depicts a isometric view of the present invention. The wedge installer tool 200 is constructed from hardened steel or similar material and includes a magnetized tip 202, shaft 204, stop 206, hammer member 208 and handle member 212. Shaft 204 of wedge installer tool 200 generally extends along longitudinal axis 201. The cross-section shape of shaft 204 is generally u-shaped cross-section so that it can slide along and straddle over tendon 104 (see FIG. 4). The interior diameter of shaft 204, therefore, must be large enough to fit over tendon 104 with sufficient clearance that shaft 204 can slid along tendon 104 (see FIG. 4). Typically, tendons currently in use for post-tensioning are approximately one half inch in diameter. One end of shaft 204 is bent to form transition member 210 and, then bent again to form handle member 212. Handle member 212 is offset from longitudinal axis 201 and has a sufficient length so that a human hand can grab handle member 212 and use it to slide wedge installer tool 200 along tendon 104 without touching or interfering with tendon 104 (FIG. 1).

Figure 6A:
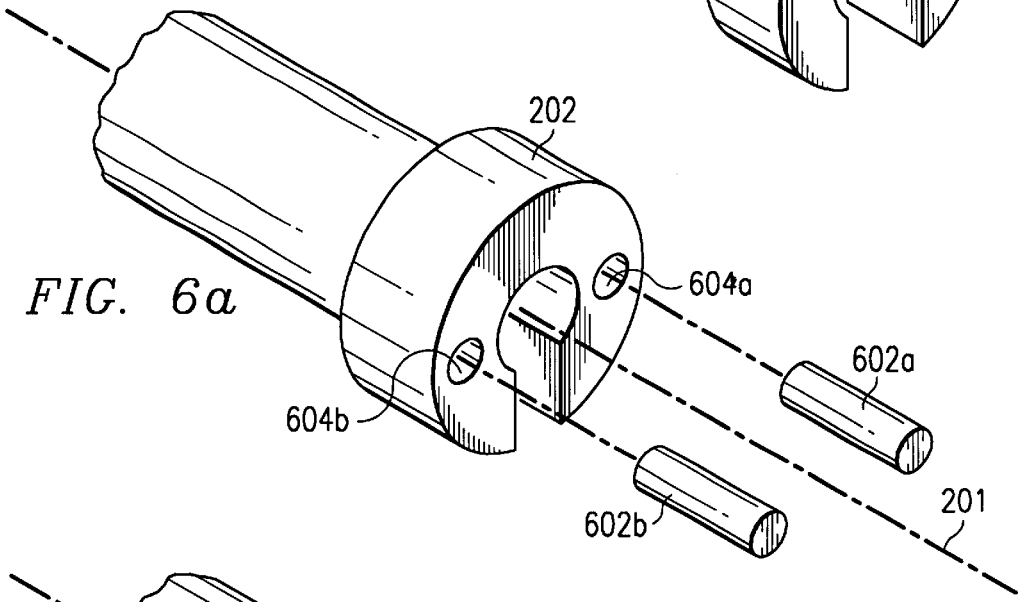
FIG. 6*a* and 6*b* are isometric views of two embodiments of the tool tip of the present invention.
Figure 6B:
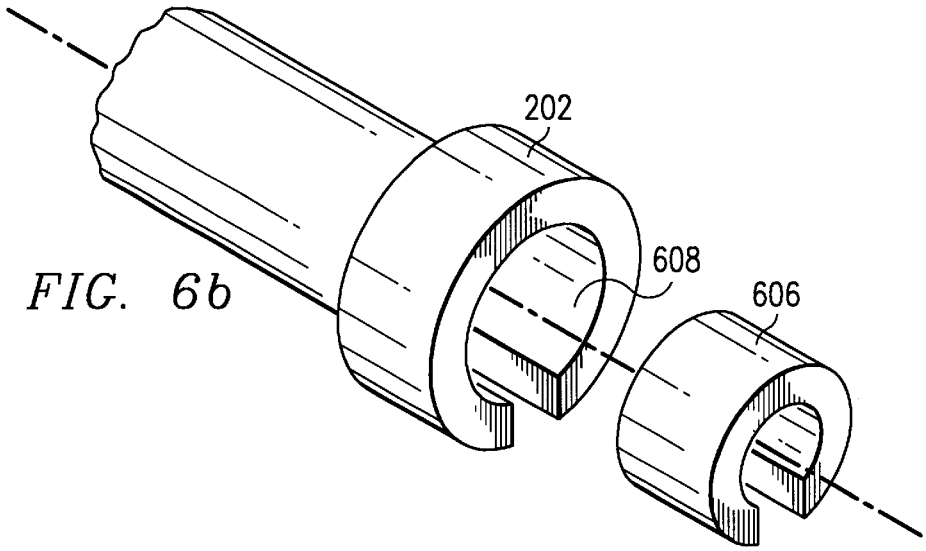

Tip 202 is at the opposite end of shaft 204 from handle member 212. Tip 202 is either magnetized or has a sufficient diameter to contain recesses for magnets. FIG. 6*a* an exploded isometric view of one embodiment of tip 202. Magnets 602*a* and 602*b* are embedded in cylindrical openings 604*a* and 604*b* in the front face of tip 202. Cylindrical openings 604*a* and 604*b* have longitudinal axises substantially parallel to axis 201. FIG. 6*b* is an exploded isometric view of another embodiment of tip 202. Annular magnet 606 is mounted in concentric circular recess 608 on the front face of tip 202. In both embodiment, the magnets releasably hold anchorage wedges 108*a* and 108*b* to tip 202 (See FIG. 3). This support arrangement for anchorage wedges 108*a* and 108*b* permits the anchorage wedges to be inserted into anchorage cavity 102 without the need for additional support.

Figure 4:
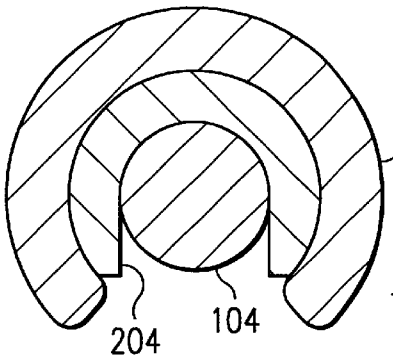
FIG. 4 is a cross sectional view of the present invention.
Figure 5:
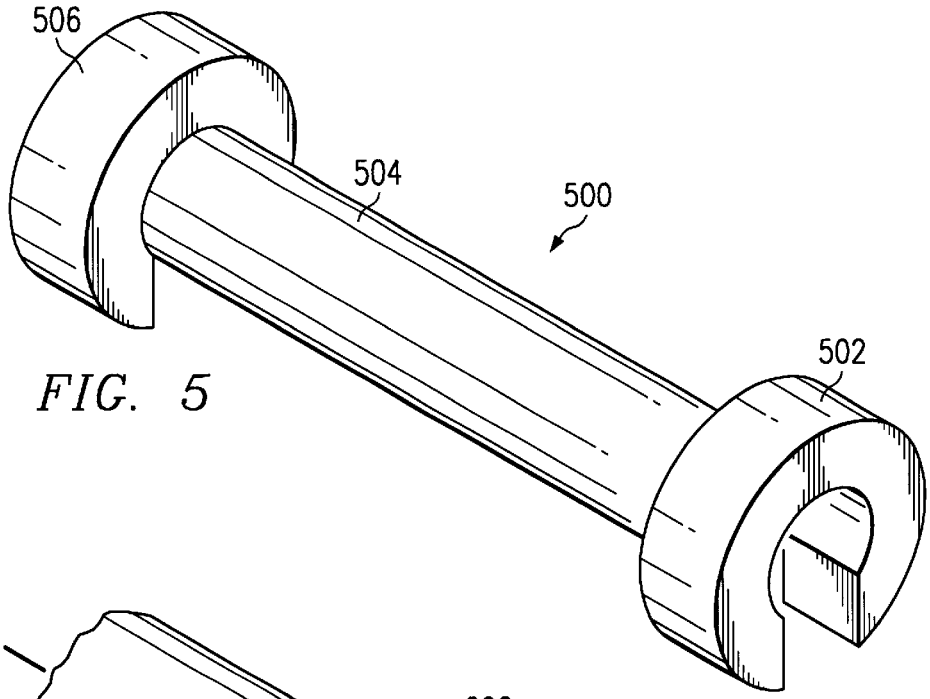
FIG. 5 is an isometric view of another embodiment of the hammer member of the present invention.

Farther along shaft 204, is stop 206. Stop 206 extends radially outwardly from shaft 204. Stop 206 has a cross-section greater than the cross-section of shaft 204. Hammer member 208 is slidably mounted on shaft 204 for longitudinal movement along the shaft. The cross-section shape of hammer member 208 is also generally u-shaped which allows for the entire tool to straddle or to be slidably mounted on a steel tendon. This interengagement is more clearly shown is FIG. 4. FIG. 4 is a transverse cross-section view showing tendon 104 partially surrounded by shaft 204. Shaft 204 is also partially surrounded by hammer member 208. Hammer member 208 is a combined weight and handgrip. In one embodiment, hammer member 208 is roughly cylindrical in shape and includes a roughen cross-hatched exterior surface for providing positive, easy gripping by the user of the tool (See FIG. 3). FIG. 5 is an isometric view of another embodiment of the hammer member. Hammer member 500 has enlarged ends 502 and 506 and a handle portion 504. The overall shape of hammer member 500 is similar to a dumbbell. Enlarged ends 502 and 506 provide extra weight to hammer member 506 and handle portion 504 acts as a handle. The cross-section shape of hammer member 500 is similar to hammer member 208. The cross-section is generally u-shaped and is designed such that hammer member 500 can straddle or partially surround and fit over shaft 204 such that hammer member 500 can be slidably mounted onto shaft 204 (see FIG. 4).

Figure 3:
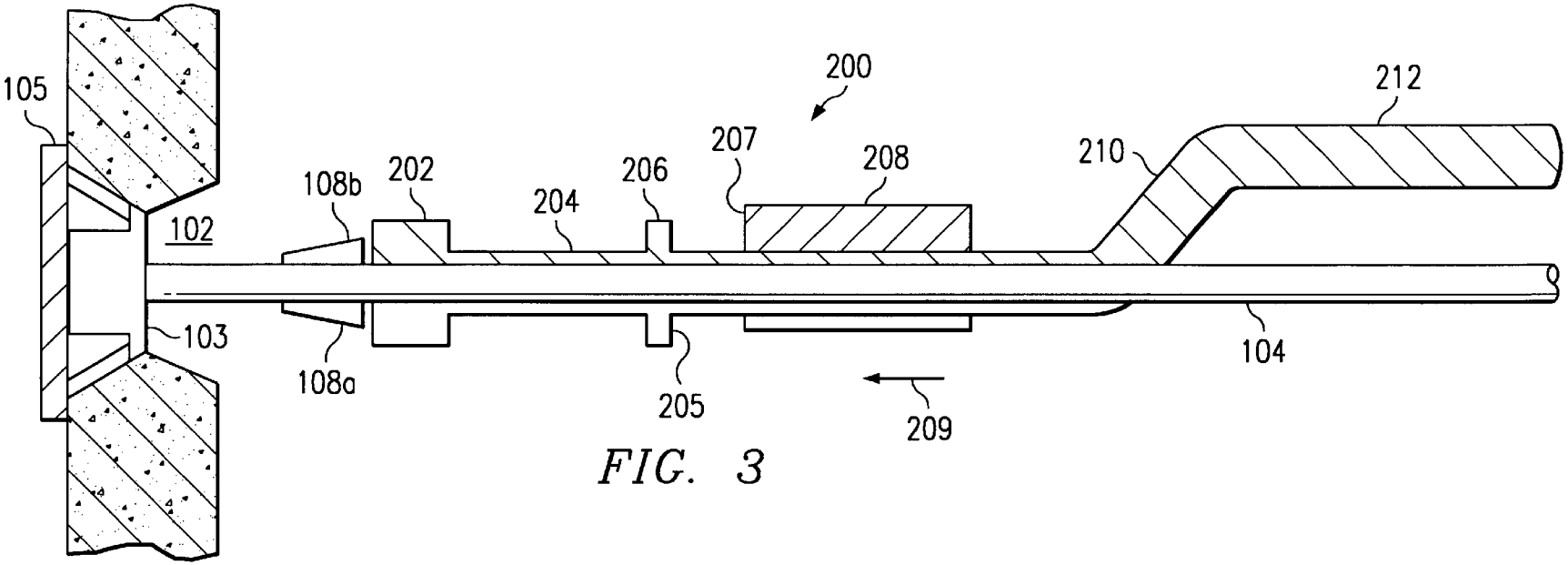
FIG. 3 is a longitudinal cross sectional view of the present invention straddling a tendon protruding from a concrete structure.

FIG. 3 shows a longitudinal cross section of tool 200 mounted on tendon 104 which is protruding from anchorage 105. Wedges 108*a* and 108*b* are shown magnetically attached to tip 202 before they are seated into anchorage 105. Stop 206 includes pounding surface 205. Hammer member 208 also includes a pounding surface 207 corresponding to pounding surface 205. Hammer member 208 and stop 206 operate as a conventional slide hammer to impart a pounding force or longitudinal force in direction 209 on the pounding surface 205. Direction 209 is generally parallel to the longitudinal axis of shaft 204. The pounding force is then transferred to shaft 204, which imparts a similar force to tip 202, and then to wedge 108*a* and 108*b*.

OPERATION

To begin the installation of wedges 108*a* and 108*b*, wedge installer tool 200 is positioned such that it slides over tendon 104 as illustrated in FIG. 3. Next, the user positions wedges 108*a* and 108*b* on tool tip 202. The user then slides wedges 108*a* and 108*b* in direction 209 driving the wedges into anchorage 105. The user slides hammer member 208 towards handle member 212. The user then slides hammer member 208 along shaft 204 parallel to direction 209 until pounding surface 207 of hammer member 208 makes contact pounding surface 205 of stop 206. This sliding action and contact causes the momentum of the slide hammer 205 to be transferred as a longitudinal or pounding force to stop member 206 which imparts a force down shaft 204 to wedges 108*a* and 108*b* which forcibly drive the wedges evenly into anchorage 105. The user may have to repeat the last step of this process (sliding of hammer member 208 along shaft 204 in direction 209) until both wedges 108*a* and 108*b* are completely seated around tendon 104. Once the wedges 108*a* and 108*b* are completely seated, the user pulls on handle member 212 which slides wedge installer tool 200 away from the concrete. This disengages the magnetic force used initially to hold the wedges 108*a* and 108*b*. The user then removes the tool simply by sliding it off tendon 104.

The wedge installation tool has substantial advantages over the prior art. Rather than having to hold each wedge individually while the wedges are driven into the cavity, the wedge seating tool's magnetized head properly hold the wedges in place before they are placed into the cavity. Furthermore, the wedge seating tool saves the operator a significant amount of time because the operator can seat both wedges simultaneously. Additionally, because both wedges are seated by the same surface and impact, both wedges are seated an equal amount. Unequal seating results in excessive tendon slippage and tension failure of the tendons.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It is therefore, contemplated that the claims will cover any such modifications or embodiments that fall within the true scope of the invention.

What is claimed is:

1. A method for installing anchorage wedges between a concrete anchorage and a reinforcement tendon extending through the concrete anchorage, the method comprising the steps of:

(a) positioning one or more anchorage wedges adjacent to the reinforcement tendon with a magnetic means, and (b) applying a longitudinal force to the anchorage wedges into space between the concrete anchorage and the reinforcement tendon.

2. The method of claim 1, further comprising the step of repeating step (b) until the anchorage wedges are sufficiently driven between the concrete anchorage and the reinforcement tendon.

3. The method of claim 1, wherein the applying a longitudinal force step is accomplished by a sliding hammer means.

4. An apparatus for installing anchorage wedges into a wedge receiving seat comprising:

an elongated shaft, a tip about a first end of said elongated shaft said tip containing at least one permanent magnet for supporting said anchorage wedges; and a hammer member receiving reciprocatingly said elongated shaft such that said hammer member can reciprocate along said elongated shaft to impart a force to said elongated shaft.

5. The apparatus of claim 4, further comprising a stop member on the periphery of said elongated shaft wherein said stop member has a surface for receiving said longitudinal force from said hammer member.

6. The apparatus of claim 4, wherein said tip has a cross-sectional shape such that it can straddle a substantially round reinforcement tendon extending from said wedge receiving seat.

7. The apparatus of claim 4, wherein said elongated shaft has a cross-sectional shape such that it can straddle a substantially round reinforcement tendon.

8. The apparatus of claim 4, wherein said hammer member has a cross-sectional shape such that it can straddle said elongated shaft.

9. The apparatus of claim 4, wherein a second end of said elongated rod is attached to handle to impose a stationary reference with respect to said hammer member.

10. An apparatus for installing anchorage wedges into a wedge receiving seat comprising:

an elongated shaft, a first end of said elongated shaft with a means for positioning and holding said anchorage wedges, a stop member on the periphery of said elongated shaft with an impact surface, and a hammer member mounted on said elongated shaft for sliding movement along said elongated shaft, said hammer member including an impact surface to correspond with said impact surface of said stop member.

11. The apparatus of claim 10, wherein said elongated shaft has a cross-sectional shape such that it can straddle a substantially round reinforcement tendon extending from said wedge receiving seat.

12. The apparatus of claim 10, wherein said hammer member has a cross-sectional shape such that it can straddle said elongated shaft.

13. The apparatus of claim 10, wherein said hammer member has a weighting means.

14. The apparatus of claim 10, wherein a second end of said elongated shaft is attached to a transition member for attaching a handle means to said elongated shaft.

* * * * *